US008245352B2

(12) United States Patent
Park

(10) Patent No.: US 8,245,352 B2
(45) Date of Patent: Aug. 21, 2012

(54) HINGE ASSEMBLY AND REFRIGERATOR WITH HINGE ASSEMBLY

(75) Inventor: Sung Jin Park, Changwon (KR)

(73) Assignee: LG Electronics Inc., Seoul (KR)

( * ) Notice: Subject to any disclaimer, the term of this patent is extended or adjusted under 35 U.S.C. 154(b) by 252 days.

(21) Appl. No.: 12/673,321

(22) PCT Filed: Apr. 1, 2009

(86) PCT No.: PCT/KR2009/001667

§ 371 (c)(1),
(2), (4) Date: Feb. 12, 2010

(87) PCT Pub. No.: WO2009/123416

PCT Pub. Date: Oct. 8, 2009

(65) Prior Publication Data

US 2011/0209495 A1 Sep. 1, 2011

(30) Foreign Application Priority Data

Apr. 2, 2008 (KR) ..... 10-2008-0030699

(51) Int. Cl.
*E05D 7/10* (2006.01)

(52) U.S. Cl. ..... 16/258; 16/262; 16/382; 16/268

(58) Field of Classification Search ..... 16/258, 16/257, 262, 265, 266, 271, 267, 381, 385, 16/382; 312/326, 405, 227; 49/381, 397, 49/388

See application file for complete search history.

(56) References Cited

U.S. PATENT DOCUMENTS

| | | | | | |
|---|---|---|---|---|---|
| 3,023,451 | A | * | 3/1962 | Thoel | 16/258 |
| 3,869,753 | A | * | 3/1975 | Boback | 16/382 |
| 5,666,764 | A | * | 9/1997 | Beatty et al. | 49/397 |
| 5,870,801 | A | * | 2/1999 | Kim | 16/382 |
| 5,960,518 | A | * | 10/1999 | Jeong | 16/270 |
| 6,070,300 | A | * | 6/2000 | Shin et al. | 16/382 |
| 6,085,385 | A | * | 7/2000 | Joo | 16/268 |
| 6,128,807 | A | * | 10/2000 | Lim et al. | 16/266 |

FOREIGN PATENT DOCUMENTS

| | | | |
|---|---|---|---|
| JP | 11-159948 | A | 6/1999 |
| KR | 10-0169462 | B1 | 10/1998 |
| KR | 20-0309593 | Y1 | 4/2003 |

* cited by examiner

*Primary Examiner* — Chuck Y. Mah
(74) *Attorney, Agent, or Firm* — Birch, Stewart, Kolasch & Birch, LLP

(57) ABSTRACT

Provided are a hinge assembly that is pivotably supported to a hinge plate for pivotably supporting a door, and which is provided with an integrally coupled retaining lever that selectively fixes the hinge plate, and a refrigerator provided with the hinge assembly. The hinge assembly includes a fixing member, the hinge plate, and the retaining lever. The fixing member projects to an upper surface of a refrigerator main body. The hinge plate is pre-fixed to the refrigerator main body, with a portion of the fixing member inserted in one portion of the hinge plate and a refrigerator door pivotably mounted to another portion of the hinge plate. The retaining lever is pivotably coupled to the hinge plate, to selectively retain the hinge plate through rotating horizontally about the hinge plate.

9 Claims, 3 Drawing Sheets

[Fig. 1]
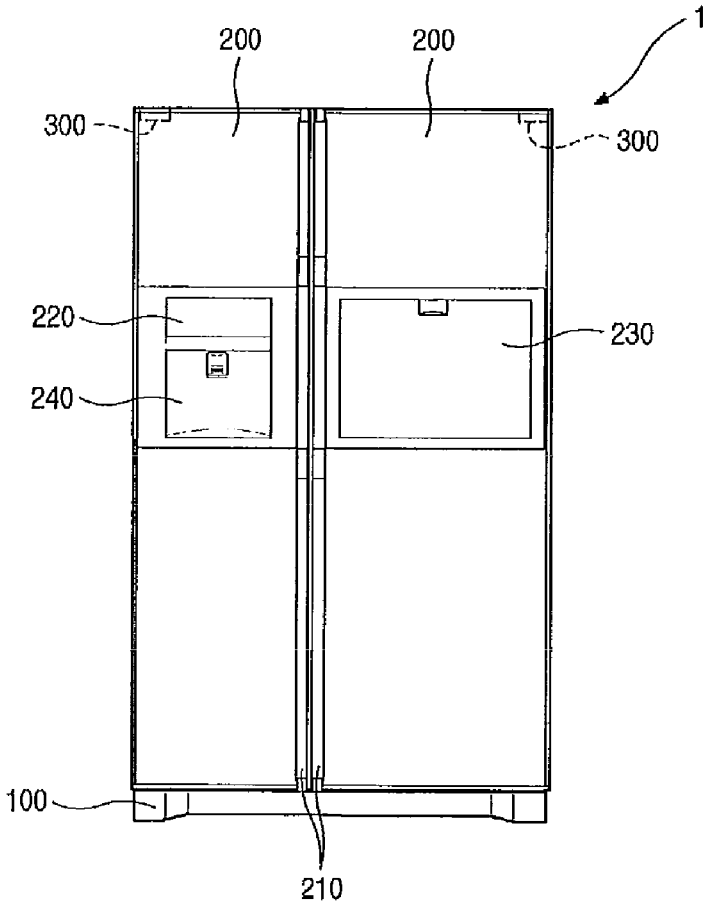
[Fig. 2]
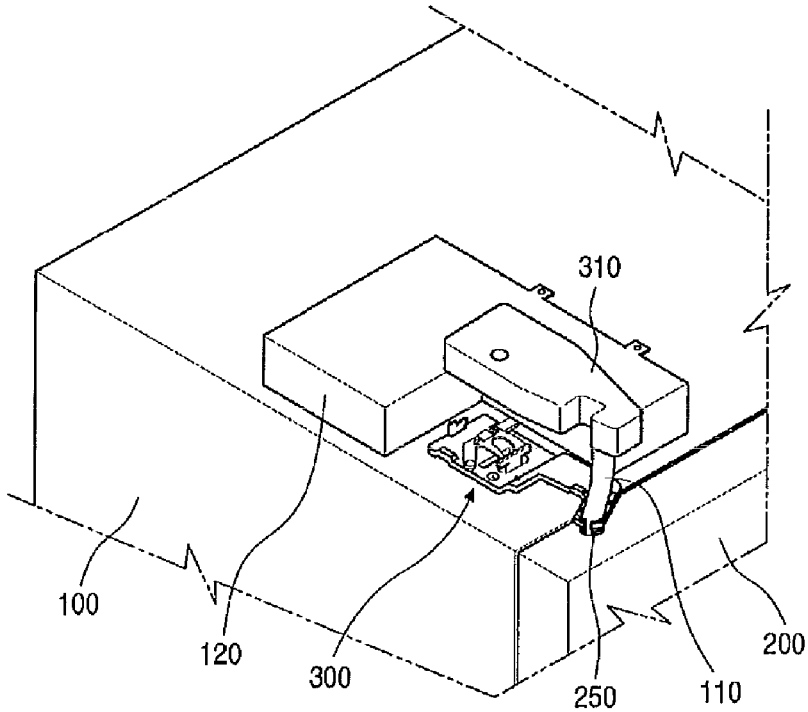

[Fig. 3]
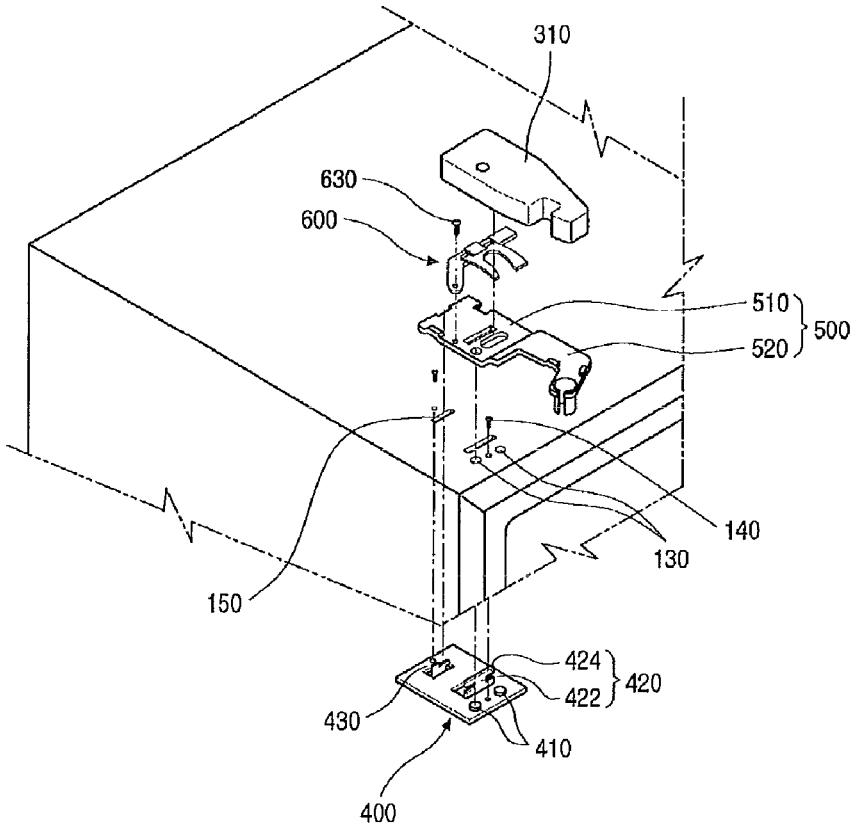
[Fig. 4]
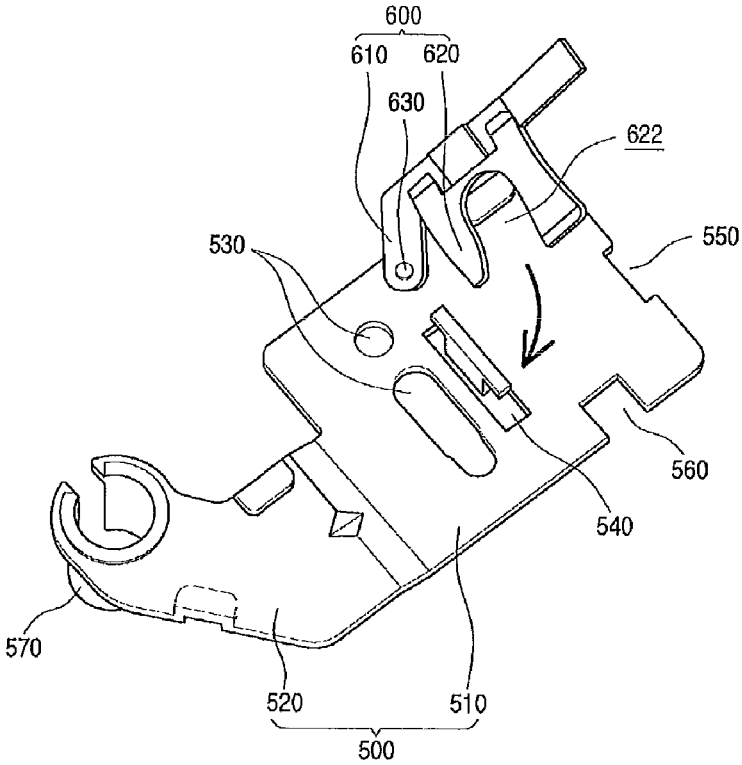

[Fig. 5]
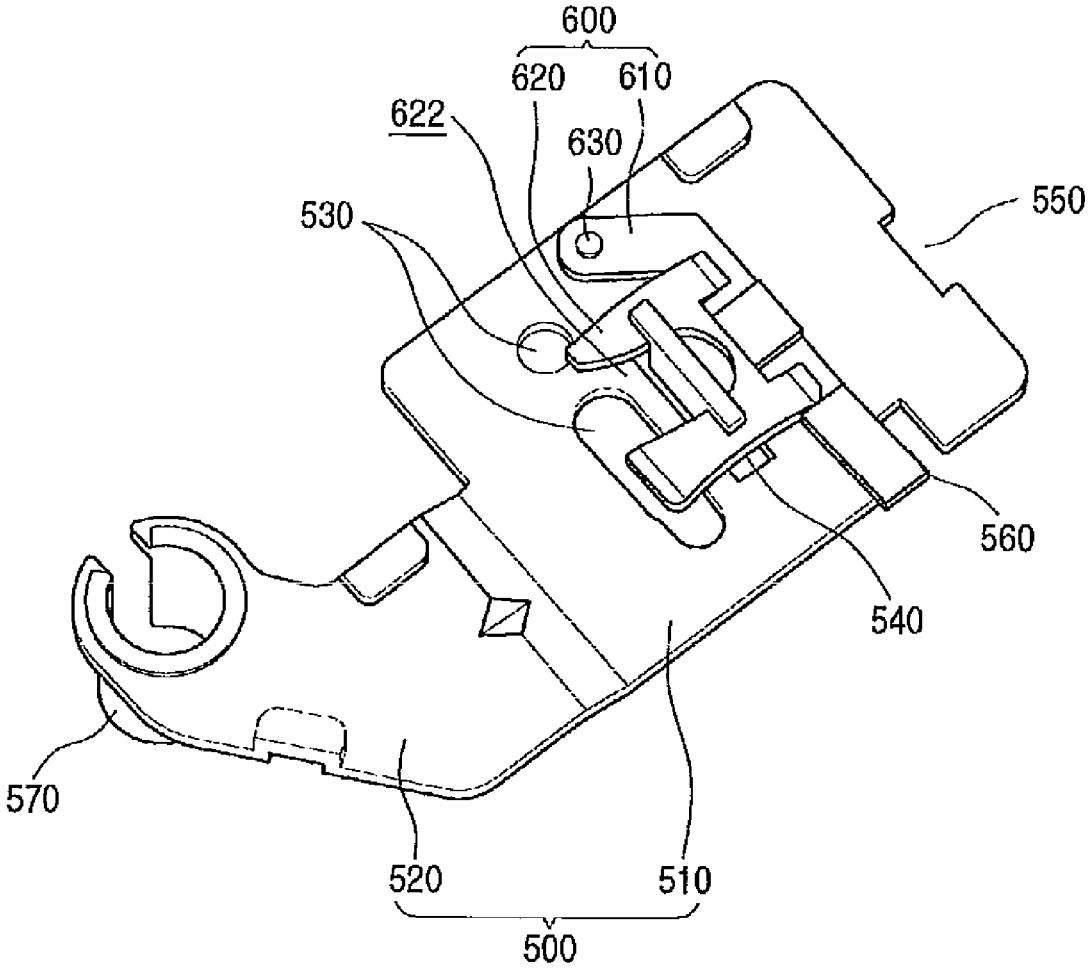

HINGE ASSEMBLY AND REFRIGERATOR WITH HINGE ASSEMBLY

TECHNICAL FIELD

The present disclosure relates to a hinge assembly and a refrigerator provided with a hinge assembly.

BACKGROUND ART

In general, a refrigerator is a home appliance for storing foods at low temperature inside a storage compartment that is opened and closed by a refrigerator door, and employs cold air generated by heat exchange with refrigerant circulating in a refrigeration cycle to cool the inside of the storage compartment and preserve stored foods under optimum conditions.

Such refrigerators are increasingly being manufactured with larger dimensions and multi-functions due to changing consumer eating habits and luxury-oriented buyer preferences, and refrigerators are being marketed with a wide selection of configurations and convenience features intended to improve user convenience.

Compared to related art refrigerators, such newer refrigerators are often shipped and delivered with their doors detached to facilitate transport, due to their increased size. Also, doors must be detached from the main body in some cases for service and maintenance.

However, because a refrigerator door is mounted to a refrigerator main body through a fixed hinge assembly with a strong coupled force through the use of bolts, screws, etc., it is virtually impossible for a user to detach or reattach a door of the user's own volition.

Accordingly, various hinge assemblies are being developed to allow a user or a technician to quickly and easily detach or reattach a refrigerator door.

First, in Korean Registration No. 0728385, which is hereby incorporated by reference in its entirety, a fastening bracket is provided on the main body of a refrigerator, and a hinge plate pivotably coupled to a door is coupled to the fastening bracket. Also, by inserting and rotating a separately formed fixing lever in the fastening bracket, the hinge plate is fixed.

Also, in Korean Patent Publication Nos. 1999-0063575 and 1999-026937, which are hereby incorporated by reference in their entirety, a hinge plate pivotably coupled to a door is coupled to a fixing bracket mounted on a refrigerator main body, and the fixing bracket is provided with a lever for pressing and fixing the hinge plate in a vertical rotation. After the lever is inserted in the fixing bracket, it is pressed to fix the hinge plate.

However, the above related art has the following limitations.

The above-described examples of the related art are all configured with a fixing lever or lever formed as a detachable separate member to fix a hinge plate during the process of attaching or detaching a door.

That is, when detaching the hinge plate, the fixing lever or the lever is rotated to perform unlocking, and the fixing lever or the lever must be detached in order to separate the hinge plate from the main body.

Accordingly, the fixing lever or lever can be misplaced during disassembly and assembly processes, and, should such a misplacement occur, it presents a major problem that prevents the door from being mounted.

DISCLOSURE OF INVENTION

Technical Problem

Embodiments provide a hinge assembly that is pivotably supported to a hinge plate for pivotably supporting a door, and is provided with an integrally coupled retaining lever that selectively fixes the hinge plate, and to a refrigerator provided with the hinge assembly.

Technical Solution

In one embodiment, a hinge assembly comprising: a fixing member upwardly projecting at an upper surface of a refrigerator main body; a hinge plate through which at list a portion of the projecting part of the fixing member penetrates, a refrigerator door being pivotably mounted to the hinge plate; and a retaining lever coupled to the hinge plate by horizontally rotating along the upper surface of the hinge plate such that the hinge plate is selectively retained to the fixing member.

In another embodiment, a refrigerator comprising: a main body defining a storage compartment; a door mounted to the main body to selectively open and close the storage compartment; a hinge plate mounted on an upper surface of the main body, the door being rotatably coupled to the hinge plate; a retaining lever rotatably coupled to an upper surface of the hinge plate, such that the hinge plate is selectively fixed to the upper surface of the main body.

Advantageous Effects

In a hinge assembly and a refrigerator provided with a hinge assembly according to the present disclosure, when disassembling or assembling a door that mounts to a main body, a retaining lever integrally mounted on a hinge plate is rotated to selectively fix the hinge plate and thus disassemble or assemble the door.

Here, because the retaining lever is integrally formed with the hinge plate, it does not disengage from the hinge plate during disassembly or assembly procedures, thus preventing the possibility of misplacing the retaining lever.

Accordingly, because a user or technician can freely perform disassembly or assembly without having to worry about misplacing the retaining lever, user convenience and servicing convenience can be improved.

Also, during assembly of a hinge plate provided as a pre-integrated component, assembly can be performed by simply pivoting the retaining lever, to thereby increase product yield.

BRIEF DESCRIPTION OF THE DRAWINGS

FIG. 1 is a view of a refrigerator provided with a hinge assembly according to the present disclosure.

FIG. 2 is a partial perspective view of a mounted hinge assembly according to the present disclosure.

FIG. 3 is an exploded perspective view showing the configuration of a hinge assembly according to the present disclosure.

FIG. 4 is a perspective view showing a retaining lever of a hinge assembly in an open state according to the present disclosure.

FIG. 5 is a perspective view showing a retaining lever of a hinge assembly in a closed state according to the present disclosure.

BEST MODE FOR CARRYING OUT THE INVENTION

Reference will now be made in detail to the embodiments of the present disclosure, examples of which are illustrated in the accompanying drawings. However, it should be understood that the present disclosure is not limited to embodiments disclosed herein, and that through adding other elements or modifying or deleting existing elements, other embodiments can easily be devised that will fall within the spirit and scope of the principles of this disclosure.

While a hinge assembly and a refrigerator provided with a hinge assembly according to the present disclosure can be applied to all refrigerators provided with a hinge assembly, for descriptive convenience and ease of understanding, the description below will pertain to a French door-type refrigerator provided as an example.

FIG. 1 is a view of a refrigerator provided with a hinge assembly according to the present disclosure. Referring to FIG. 1, a refrigerator 1 has an overall hexahedral shape, and includes a main body 100 with at least one storage compartment, and a door 200 opening and closing the storage compartment, which constitute the exterior of the refrigerator.

The main body 100 is formed in a hexahedral shape with an open front surface, and the storage compartment is defined in the main body 100 to store food. The storage compartment is partitioned into a refrigeration compartment and a freezer compartment to the left and right sides, and each storage compartment is selectively opened and closed by a door 200.

The door 200 selectively opens and closes the open front surface of the refrigerator 1—that is, the refrigeration compartment and the freezer compartment, and has the same shape as the open surfaces of the refrigeration compartment and the freezer compartment. Also, the door 200 retains cold air in the storage compartments when closed, and also constitutes the exterior front surface of the refrigerator 1.

The tops and bottoms of the doors 200 opening and closing the refrigeration compartment and the freezer compartment are pivotably coupled respectively to the main body 100, and the doors 200 pivot about the coupled portions to the left and right, respectively, to selectively open and close the refrigeration compartment and the freezer compartment.

In particular, the top ends of the doors 200 are coupled to the main body 100 through hinge assemblies 300 provided at the top end of the main body 100. The hinge assemblies 300 enable the doors 200 to be detachably mounted to the main body 100, and a detailed configurative description thereof will be provided below.

Also, hinges, pivotably coupled to the bottom of the main body 100 and pivotably coupled to and supporting the doors 200, are the same as hinges used in conventional refrigerators, and thus a detailed description thereof will not be provided.

A door handle 210 for users to grasp and pivot the doors 200 is provided on the front surfaces of the doors 200, and also, a display 220 for a user to check operating conditions, a home bar 230 for allowing withdrawal of foods within the storage compartments without opening the doors 200, and a dispenser 240 for dispensing water or ice may selectively be provided on the doors 200.

FIG. 2 is a partial perspective view of a mounted hinge assembly according to the present disclosure, showing an upper surface of the door 200 and an upper surface portion of a main body 100. Referring to FIG. 2, the outer side of the upper surface of the door 200 and a corresponding outer side of the upper surface of the main body 100 are connected to one another through the hinge assembly 300.

Here, the door 200 is pivotably mounted through an axis to the front end of a hinge plate 500 (in FIG. 3) that is a component of the hinge assembly 300. The other end of the hinge plate 500 is fixed to the main body 100 to securely support the pivotally mounted door 200.

The inside of the door 200 may be configured with a plurality of electrical components required for a dispenser 240, display 220, ice maker, etc., and a structure for supplying water.

In this case, a wire 110 for supplying electricity to the electrical components and a water supply hose for supplying water are guided through a hinge pin 570 (in FIGS. 4 and 5) coupling the door 200 and hinge plate 500 to one another. That is, a wire 110 guided to the outside of the door 200 through a cylindrical hinge pin 570 is connected through a connector on a main printed circuit board (PCB) or a sub PCB 120, and the water supply hose is guided to the inside of the main body 100.

A hinge cover 310 is provided above the hinge assembly 300 to cover the components of the hinge assembly 300, the wire 110, and the water supply hose. The hinge cover 310 is open at the bottom, and defines a predetermined space within to cover the hinge assembly 300, wire 110, and water supply hose when the hinge cover 310 is mounted to the main body 100.

Of course, when there is no need to guide a wire 110 and water supply hose through the hinge pin 570, the hinge pin 570 may be formed as a solid rod, and the hinge cover 310 may not be provided.

FIG. 3 is an exploded perspective view showing the configuration of a hinge assembly according to the present disclosure. Referring to the diagrams, the hinge assembly 300 is formed of a fixing member 400, a hinge plate 500, and a retaining lever 600.

The fixing member 400 is for fixing the hinge plate 500, is formed in an approximately rectangular plate shape, and is mounted at an upper portion within the main body 100. The fixing member 400 is fixed with screws at the upper surface of the main body 100 to be pressed against the inside of the upper surface of the main body 100, and contacts a thermal insulator filled with foam inside the main body 100.

A fixing protrusion 410 is formed at both the left and right (in FIG. 3) at the front of the fixing member 400. The fixing protrusions 410 are formed to extend upward from the upper surface of the fixing member 400, and are formed of lengths corresponding to a protrusion through-hole 130 formed in a corresponding position in the main body 100 and a fixing protrusion receiving hole 530 formed in the hinge plate 500, to be received in the through-hole and receiving hole, respectively.

Also, a fixing portion 420 protruding upward is formed in the approximate center to the rear (the right in FIG. 3) of the fixing protrusions 410. The fixing portion 420 is for fixing the hinge plate 500, and extends upward to sequentially pass through a protruding portion through-hole 140 in the upper surface of the main body 100 and a through-hole 540 of the hinge plate 500.

The fixing portion 420 may be formed by cutting a portion of the fixing member 400 and bending it upward, or may be coupled to the fixing member 400, depending on requirements.

To describe the fixing portion 420 in more detail, the fixing portion 420 is formed as a laterally-elongated plate, and includes an extending portion 422 extending vertically upward, and a catching portion 424 projecting to the left and right of the extending portion 422.

The extending portion 422 is formed of a height corresponding to a height of a retaining lever 600 (to be described in detail below) so that a portion of the retaining lever 600 can be inserted therein. The fixing member 400 is formed such that the catching portion 424 can contact the retaining lever 600 when the retaining lever 600 is inserted.

A supporting portion 430 is formed at the rear portion of the fixing member 400. The supporting portion 430 projects upward past a supporting portion through-hole 150 in the upper surface of the main body 100 and is received in a receiving recess 550 of the hinge plate 500, to retain the hinge plate 500 and prevent it from rotating or moving.

The hinge plate 500 is mounted on the upper surface of the main body 100. The hinge plate 500 is formed as plate that is longer than the fixing member 400, to connect the door 200 and the main body 100 and mount the door 200 to be capable of pivoting.

In further detail, the hinge plate 500 includes a coupling portion 510 that couples to the main body 100, and a connecting portion 520 that extends from the coupling portion 510 to couple with the door 200.

The coupling portion 510 has a plate shape corresponding to the fixing member 400, and the coupling portion 510 forms fixing protrusion receiving holes 530 at left and right sides of the front edge thereof (the left side in FIG. 3). The fixing protrusion receiving holes 530 are formed to receive the fixing protrusions 410 of the fixing member 400. Here, the fixing protrusion receiving holes 530 are provided at the left and right, respectively, and one of the protrusion receiving holes 530 is elongatedly formed to standardize the hinge plate 500.

A through-hole 540 is defined at the rear of the fixing protrusion receiving holes 530. The through-hole 540 is for passing the fixing portion 420 of the fixing member 400 through, is formed in the shape of an elongated slit extending from left to right to enable the fixing portion 420 to pass through, and is formed at a position corresponding to the fixing portion 420 and the fixing portion through-hole 140.

Also, a receiving recess 550 is formed cut into the rear of the coupling portion 510 to accommodate the supporting portion 430 of the fixing member 400 therein. The receiving recess 550 is formed correspondingly above the supporting portion 430 with a corresponding size.

A fastening recess 560 is formed cut into a side of the coupling portion 510 to accommodate the head of a screw therein, and through receiving the supporting portion 430 in the receiving recess 550 and fastening a screw to the fastening recess 560, the hinge plate 500 can be fixed to not rotate.

The retaining lever 600 is coupled proximate to through-hole 540 at the left side (as shown in FIG. 3) of the coupling portion 510. The retaining lever 600 is for selectively retaining and fixing the hinge plate 500, and is formed of a manipulating portion 610 and a functioning portion 620.

The manipulating portion 610 is a portion that a user manipulates to rotate the retaining lever 600, and is pivotably coupled at one end by means of a coupling member 630 to the left side of the hinge plate 500. The coupling member 630 may be a pin, screw, bolt, nut, or any other member enabling pivoting coupling of the hinge plate 500 and the manipulating portion 610, and the coupling member 630 integrally couples the hinge plate 500 and the retaining lever 600.

After extending from its portion coupled by the coupling member 630, the manipulating portion 610 is bent at a predetermined angle, so that coupling between the fixing portion 420 of the fixing member 400 and the retaining lever 600 can be performed easily through manipulating the manipulating portion 610.

When the manipulating portion 610 is moved to a closed position to rotate the retaining lever 600 and fix the hinge plate 500, its end is made not to deviate from the hinge plate 500 so that it does not interfere when the hinge cover 310 is mounted.

The functioning portion 620 is for inserting in the fixing portion 420 and retaining the hinge plate 500, and is formed to protrude laterally from the approximate center of the manipulating portion 610. The functioning portion 620 is plate-shaped with a predetermined area, and is formed to have an overall upward or downward curvature. That is, the functioning portion 620 is formed to be the most convex or concave at the center, and progressively decreases in curvature toward the edges. This is to progressively press and fix the functioning portion 620 against the hinge plate 500 as the former is contacted with the fixing portion 420.

A guide groove 622 is formed at one end of the functioning portion 620. The guide groove 622 is defined from the outer edge of the functioning portion 620 inwards in a bevel-shaped recess, and corresponds in width to the fixing portion 420, so that the extending portion 422 of the fixing portion 420 can be inserted into the guide groove 622 when the retaining lever 600 is rotated.

The extending portion 520 extending from the front end of the coupling portion 510 is bent toward the outside of the door 200 after extending forward. Also, the hinge pin 570 is inserted and installed in the end of the extending portion 520.

The hinge pin 570 is inserted in the hinge hole 250 formed in a shape corresponding to the upper surface of the door 200, is mounted to enable the door 200 to pivot, and extends a predetermined length. The hinge pin 570 is formed in the shape of a tube to guide the wire 110 and water supply hose.

Below, the functions of the above-configured hinge assembly and a refrigerator provided with the hinge assembly will be described with reference to diagrams.

FIG. 4 is a perspective view showing a retaining lever of a hinge assembly in an open state according to the present disclosure, and FIG. 5 is a perspective view showing a retaining lever of a hinge assembly in closed state according to the present disclosure.

Referring to the diagrams, first, with the door 200 fixedly mounted on the main body 100, FIG. 4 shows an open state of the retaining lever 600.

In further detail, the door 200 is pivotably coupled to the hinge pin 570 of the hinge plate 500, and the retaining lever 600 is rotated such that the functioning portion 620 of the retaining lever 600 is interposed between the hinge plate 500 and the catching portion 424 of the fixing member 400.

Here, the bottom of the functioning portion 620 presses against the hinge plate 500, and the catching portion 424 of the fixing portion 420 that is passed through the hinge plate 500 presses against either side of the functioning portion 620 so that downward pressure is applied on the hinge plate 500. Also, the respective fixing protrusions 410, fixing portion 420, and supporting portion 430 are received in the hinge plate 500 to maintain a securely fixed state.

In this state, in order to separate the door 200, the retaining lever 600 is rotated in a counterclockwise direction. When the retaining lever 600 is rotated counterclockwise, the guide groove 622 of the functioning portion 620 is disengaged outwardly from between the catching portion 424 of the fixing member 400 and the hinge plate 500. Here, the extending portion 422 of the fixing portion 420 is disengaged from the guide groove 622 of the functioning portion 620.

When the functioning portion 620 is completely disengaged from the catching portion 424 and the hinge plate 500, the state in FIG. 4 is realized, and the downward pressure that was applied to the hinge plate 500 is removed, and retaining force is removed to enable upward removal of the hinge plate 500.

Accordingly, a user or technician can upwardly remove the hinge plate 500, and the upper coupling between the door 200 and the main body 100 is negated through the removal of the hinge plate 500. Thus, a user can lift the door 200 upward to completely separate the door 200 from the main body 100.

After the door 200 is separated, the main body 100 and the door 200 may be respectively moved to required locations, and the door 200 may be thus separated to undergo servicing and maintenance or replacement.

To reinstall the door 200, the above procedure is performed in the reverse order.

INDUSTRIAL APPLICABILITY

In a hinge assembly and a refrigerator provided with a hinge assembly according to the present disclosure, when disassembling or assembling a door that mounts to a main body, a retaining lever integrally mounted on a hinge plate can be rotated to selectively fix the hinge plate and thus disassemble or assemble the door.

Here, because the retaining lever is integrally formed with the hinge plate, it does not disengage from the hinge plate during disassembly or assembly procedures, thus preventing the possibility of misplacing the retaining lever.

Accordingly, because a user or technician can freely perform disassembly or assembly without having to worry about misplacing the retaining lever, user convenience and servicing convenience can be improved, and also, during assembly of a hinge plate provided as a pre-integrated component, assembly can be performed by simply pivoting the retaining lever, to thereby increase product yield, for a high industrial applicability.

The invention claimed is:

1. A hinge assembly comprising:

a fixing member upwardly projecting at an upper surface of a refrigerator main body;

a hinge plate through which at least one portion of the fixing member penetrates, a refrigerator door being pivotably mounted to the hinge plate; and a retaining lever coupled to the hinge plate by horizontally rotating along the upper surface of the hinge plate such that the hinge plate is selectively retained to the fixing member, wherein the fixing member is mounted inside the refrigerator main body, such that at least a portion thereof passes through the upper surface of the refrigerator main body and the hinge plate, and wherein the fixing member comprises at least one fixing protrusion projected upwardly to pass through the refrigerator main body, in order to prevent the hinge plate from inadvertently moving, and the hinge plate defines a fixing hole in which the fixing protrusion is inserted.

2. The hinge assembly according to claim 1, wherein the retaining lever is integrally formed with the hinge plate and coupled through a coupling member to be capable of horizontal rotation.

3. The hinge assembly according to claim 1, wherein the hinge plate comprises a hinge pin with a hollow tube shape to introduce one of or both an electric wire and a water supply pipe therein.

4. The hinge assembly according to claim 1, wherein the retaining lever comprises:

a manipulating portion which is gripped by a user; and a functioning portion which is extended from the manipulating portion, wherein the functioning portion is curved upward or downward to press and retain the hinge plate.

5. The hinge assembly according to claim 4, wherein the functioning portion has a guide groove recessed in a predetermined depth to receive a portion of the fixing member when the retaining lever is rotated.

6. The hinge assembly according to claim 4, wherein the fixing member has catching portion which laterally extends at an end thereof, to make the functioning portion pressed downward.

7. The hinge assembly according to claim 6, wherein the functioning portion is configured to be placed between the catching portion and the hinge plate by rotation of the manipulating portion.

8. A refrigerator comprising:

a main body defining a storage compartment;

a fixing member upwardly projecting at an upper surface of the main body;

a door mounted to the main body to selectively open and close the storage compartment;

a hinge plate through which at least one portion of the fixing member penetrates and mounted on an upper surface of the main body, the door being rotatably coupled to the hinge plate; and a retaining lever rotatably coupled to an upper surface of the hinge plate, such that the hinge plate is selectively fixed to the upper surface of the main body, wherein the retaining lever comprises a manipulating portion which is gripped by a user and a functioning portion which is extended from the manipulating portion, and the functioning portion is curved upward or downward to press and retain the hinge plate, wherein the fixing member has a catching portion which laterally extends at an end thereof, to make the functioning portion pressed downward, and wherein the functioning portion is configured to be placed between the catching portion and the hinge plate by rotation of the manipulating portion.

9. The refrigerator according to claim 8, wherein when the retaining lever is rotated, at least a portion of the retaining lever is interposed between an upper end of the fixing member and an upper surface of the hinge plate.

* * * * *